US009700085B2

(12) United States Patent
Labat et al.

(10) Patent No.: US 9,700,085 B2
(45) Date of Patent: Jul. 11, 2017

(54) PROTECTIVE GARMENTS AND METHODS OF MAKING

(71) Applicant: Regents of the University of Minnesota, St. Paul, MN (US)

(72) Inventors: Karen Louise Labat, Circle Pines, MN (US); Linsey Ann Gordon, St. Paul, MN (US); Theresa Elizabeth Lastovich, St. Louis Park, MN (US); Elizabeth Kersch Bye, Eden Prairie, MN (US)

(73) Assignee: Regents of the University of Minnesota, Minneapolis, MN (US)

( * ) Notice: Subject to any disclaimer, the term of this patent is extended or adjusted under 35 U.S.C. 154(b) by 849 days.

(21) Appl. No.: 13/774,459

(22) Filed: Feb. 22, 2013

(65) Prior Publication Data

US 2014/0237710 A1 Aug. 28, 2014

(51) Int. Cl.

| | |
|---|---|
| ***A41B 9/08*** | (2006.01) |
| ***G21F 3/02*** | (2006.01) |
| ***A41D 13/00*** | (2006.01) |
| ***A41D 13/12*** | (2006.01) |

(Continued)

(52) U.S. Cl.

CPC ..... *A41D 13/02* (2013.01); *A41D 13/0007* (2013.01); *A62B 35/0018* (2013.01); *A41D 2300/22* (2013.01)

(58) Field of Classification Search

CPC ..... A41D 13/02; A41D 13/0007; A41D 13/0002; A41D 13/1209; A41D 13/0568; A41D 2300/22; A62B 35/0018; A62B 17/003; A62B 17/006

See application file for complete search history.

(56) References Cited

U.S. PATENT DOCUMENTS

| | | | | |
|---|---|---|---|---|
| 1,145,855 A * | 7/1915 | Wise | ..... | A41D 13/02 2/79 |
| 4,608,716 A * | 9/1986 | Brumfield | ..... | A41D 13/015 2/102 |
| 4,670,913 A | 6/1987 | Morell et al. | | |

(Continued)

FOREIGN PATENT DOCUMENTS

| | | | | |
|---|---|---|---|---|
| CN | 201219510 Y | 4/2009 | | |
| FR | 2697412 A1 * | 5/1994 | ..... | A41D 13/0007 |

(Continued)

OTHER PUBLICATIONS

Etsy.com. "60s Vintage Costume Pattern, Simplicity 6199, Child's Size 8, Animal Costume, Halloween Costume, Footed, Detachable Hood, Complete, Unisex" (URL: https://www.etsy.com/listing/242285653/60s-vintage-costume-pattern-simplicity?ga_order=most_relevant&ga_search_type=all&ga_view_type=gallery&ga_search_query=simplicity%206199&ref=sr_gallery_1).*

(Continued)

*Primary Examiner* — Jameson Collier

(74) *Attorney, Agent, or Firm* — Mueting Raasch & Gebhardt, PA

(57) ABSTRACT

Protective garments having first and second elastic straps and methods of manufacturing the same are described herein. The first strap may be positioned partially or entirely along a first strap line that extends from a left shoulder region to a right leg. The second strap may be positioned partially or entirely along a second strap line that extends from a right shoulder region to a left leg. The first and second strap lines intersect at an intersection.

19 Claims, 4 Drawing Sheets

(51) Int. Cl.
*A41D 13/02* (2006.01)
*A62B 35/00* (2006.01)

(56) References Cited

U.S. PATENT DOCUMENTS

| | | | | | |
|---|---|---|---|---|---|
| 5,048,124 | A | | 9/1991 | Lewis, Jr. et al. | |
| 5,133,092 | A | | 7/1992 | Altinger | |
| 5,487,189 | A | | 1/1996 | Bell | |
| 5,509,142 | A | | 4/1996 | Connell et al. | |
| 5,716,307 | A | * | 2/1998 | Vadher | A43B 7/20 482/124 |
| 5,829,059 | A | | 11/1998 | Covington, Jr. | |
| 5,857,947 | A | * | 1/1999 | Dicker | A63B 21/4025 2/69.5 |
| 6,006,700 | A | * | 12/1999 | Cox | A62B 35/0025 119/857 |
| 6,101,631 | A | * | 8/2000 | Ferguson, Jr. | A41D 13/0007 182/3 |
| 6,658,666 | B2 | * | 12/2003 | Schweer | A41D 13/0007 182/3 |
| 2003/0172431 | A1 | | 9/2003 | Allen | |
| 2003/0173150 | A1 | | 9/2003 | Sharp et al. | |
| 2005/0278819 | A1 | | 12/2005 | Munn et al. | |
| 2008/0250553 | A1 | | 10/2008 | Gatto et al. | |
| 2009/0019622 | A1 | | 1/2009 | Mayfield et al. | |
| 2009/0236176 | A1 | | 9/2009 | Sheu | |
| 2010/0175175 | A1 | * | 7/2010 | Helwig | A41D 13/0007 2/456 |
| 2011/0283446 | A1 | | 11/2011 | Baldauf et al. | |
| 2015/0313295 | A1 | * | 11/2015 | Bye | A41D 13/02 2/456 |

FOREIGN PATENT DOCUMENTS

| | | | | | |
|---|---|---|---|---|---|
| FR | 2819151 | A1 | | 1/2001 | |
| GB | 2074010 | A | * | 10/1981 | A41D 13/0007 |
| JP | 54-13710 | | | 1/1979 | |

OTHER PUBLICATIONS

Adams et al. "Three Methods for Measuring Range of Motion While Wearing Protective Clothing: A Comparative Study" 1993. *Intl. Journ. of Indus. Ergonomics*. 12:177-191.

Adams et al. "A Model for Protective Clothing Effects on Performance" 1994. *Intl. Journ. of Clothing Science and Technology*. 6(4):6-16.

Adams et al. "The Effect of Size and Fabric Weight of Protective Coveralls on Range of Gross Body Motions" 1995. *Am. Ind. Hyg. Assoc. J.*, 56:333-340.

Adams et al. "Methods for Assessing Protective Clothing Effects on Worker Mobility" 1996. Performance of Protective Clothing: Fifth Volume, ASTM STP 1237. , James S. Johnson and S.Z. Mansdorf, Eds., American Society for Testing and Materials. 17 pages.

Ashdown et al. "Movement Analysis as the Basis for the Development and Evaluation of a Protective Coverall Design for Asbestos Abatement" 1992. Performance of Protective Clothing: Fourth Volume, ASTM STP 1133, James P. McBriarty and Norman W. Henry, Eds., American Society for Testing and Materials, Philadelphia. 16 pages.

Ashdown et al. "Concurrent Engineering in the Design of Protective Clothing: Interfacing with Equipment Design", 1996. Performance of Protective Clothing: Fifth Volume, ASTM STP 1237, James S. Johnsona nd S.Z. Mansdorf, Eds., American Society for Testing and Materials. 15 pages.

Boorady et al. "Protective Clothing for Pesticide Applicators: A Multimethod Needs Assessment", 2009. *Journal of Textile and Apparel, Technology and Management*. 6(2):1-17.

Bradtmiller et al. "Anthropometric Sizing and Patterning of the New Eagle G-Suit (CSU-20/P)", No date. Anthropology Research Project, Inc., Box 307, Yellow Springs, OH.

Carroll. "Protective Coveralls: Reborn as a Performance Project". *Occupational Health & Safety*. Product Data Sheet. 5 pages.

Comfortable Coveralls. *Occupational Health & Safety*, Jun. 2006, 25(6):96.

Henry, Norman W. III. "Four decades of protective clothing development and standardization". *Journal of Chemical Health and Safety*. Nov./Dec. 2007. pp. 15 and 16.

Huck, J. "Protective clothing systems: A technique for evaluating restriction of wearer mobility", 1988. *Applied Ergonomics*. 19(3):185-190.

Huck, J. "Restriction to movement in fire-fighter protective clothing: evaluation of alternative sleeves and liners". 1991. *Applied Ergonomics*. 22.2:91-100.

Huck et al. "Coveralls for grass fire fighting". 1997. *Intern. Journ. of Clothing Science and Technology*. 9(5):346-359.

Huck et al. "Protective Overalls: Evaluation of Garment Design and Fit". 1997. *Intern. Journ. of Clothing Science and Technology*. 9(1):45-61.

Huck, J. "Protective Clothing Systems: A Technique for Evaluating Restriction of Wearer Mobility". 1988. *Applied Ergonomics*. 19(3):185-190.

Katz, J. "Fit for Safety". 2007. *FACILITIES*. 2 pages.

Kochar, P. "The Impact of Standardization on Limited-Use Coveralls". 1996. *Occupational Health & Safety*. Pages 22-24.

Laing et al. "Development of sizing systems for protective clothing for the adult male". 1999. *Ergonomics*. 42(10):1249-1257).

Matela. "Personal Protective Equipment should fit the Workplace". 2010. *Safety & Health*. pp. 57-58.

"New Standard Helps Users Choose Clothing for Pesticide Work". OH&S (Occupational Health & Safety). Jul. 31, 2011. 1 page.

Ng et al. "Single Parameter Model of Minimal Surface Construction for Dynamic Garment Pattern Design". 2006. IMACS Multiconference on "Computational Engineering in Systems Applications" (CESA). Oct. 4-6, 2006. Bejing, China. pp. 160-164.

Ng et al. "Dynamic Ease Allowance in Ann Raising of Functional Garment". 2008. *SEN'I GAKKAISHI*. 64(9):236-243.

Rosenblad-Wallin. "User-oriented product development applied to functional clothing design". 1985. Applied Ergonomics. 16(4):279-287.

"Selecting Garments that will be Worn". *OH&S* (*Occupational Health & Safety*). Aug. 1, 2009. 4 pages.

Tan et al. "Design and Evaluation of Thermal Protective Flightsuits. Part I: The Design Process and Prototype Development". 1998. *Clothing and Textiles Research Journal*. 16:47-55.

Turpin-Legendre et al. "Comparison of physiological and subjective strain in workers wearing two different protective coveralls for asbestos abatement tasks". 2003. *Applied Ergonomics*. 34:551-556.

Wang et al. "Body Measurements of Chinese males in dynamic postures and application" 2011. *Applied Ergonomics*. 42:900-912.

Zeigler, J.P. "Proper Sizing: The Key to Extra Durability of Protective Apparel". 2001. *Professional Safety*. pp. 14-15.

International Search Report and Written Opinion for International Application No. PCT/US2014/018050, mailed Jun. 10, 2014; 10 pages.

Simplicity Sewing Pattern No. 6199, Kids Animal Costume; 1964; pattern 4, A, p. 3. Retrieved from the Internet http://www.zibbet.com/SewMrsP/artwork?artworkId=1050208; 4pgs.

Easter, "Design of protective clothing," in *Protective clothing systems and materials*, M. Raheel (Ed.), Marcel Dekker, 1994 New York: 25-38.

McPherson, "Balancing PPE Protection With Comfort, Fit and Style," *Professional Safety*, Mar. 2008; 53(3): 50-52.

Paquette, "3D Scanning in Apparel Design and Human Engineering," *IEEE Computer Graphics and Applications*, Sep. 1996; 16(5):11-15.

International Preliminary Report on Patentability for PCT/US2014/018050 issued by the International Bureau of WIPO on Sep. 3, 2013; 9 pgs.

EPO Application No. 14753854.0, filed Feb. 24, 2014; Search Report issued Sep. 19, 2016; 7 pages.

(56) References Cited

OTHER PUBLICATIONS

BAO, Modern Garment Engineering article, Aug. 2008, Zheijiang Science & Technology Press, 231-245.

* cited by examiner

PROTECTIVE GARMENTS AND METHODS OF MAKING

Protective garments with elastic straps and methods of making the protective garments are described herein.

Limited-use or disposable garments designed to provide barrier properties such as protective coveralls are known. Coveralls can be used to protect the wearer from an environment or to protect an environment from contamination by a person wearing the garment (e.g., in the case of a cleanroom).

The coverall garments must be worn to provide the desired protection to or from the wearer. Unfortunately, typical disposable coveralls may not fit well, particularly if the wearer must engage in a variety of physical activities such as, e.g., bending, lifting, climbing, etc. To accommodate movement, some coverall designs provide larger waists and torso regions, but excess material can result in baggy, bulky, and uncomfortable garments.

SUMMARY

Protective garments with elastic straps and methods of making the protective garments are described herein. Garments that include elastic straps that, as described herein, are placed along lines that cross along the back of the garment as described herein may, in one or more embodiments, result in garments that provide better fit for a variety of individuals engaged in a variety of physical activities while wearing the garments.

In one or more embodiments, the elastic straps are in a contracted state in which excess material in the garment is gathered along the elastic straps. When the wearer bends his or her torso in any direction (e.g., forward, to the right side, to the left side, etc.), the elastic straps elongate and the gathering of the material by the elastic straps is reduced as the elastic straps elongate. In one or more embodiments, the elastic straps and material gathered along them allow for reduced restriction of the movement of a wearer along with a reduced chance of stressing or tearing of the material during that movement.

In one aspect, one or more embodiments of the protective garments described herein may include: a body comprising a front portion, a rear portion and a neck opening; a left sleeve attached to the body at a left sleeve opening and a right sleeve attached to the body at a right sleeve opening; a left leg and a right leg extending from the body; a left shoulder region located between the left sleeve opening and the neck opening; a right shoulder region located between the right sleeve opening and the neck opening; a crotch region comprising a crotch point where the left and right legs meet the body, wherein a crotch axis extends horizontally through the crotch point when the garment is worn by a person standing upright; a first strap comprising a first strap upper portion and a first strap lower portion, and a second strap comprising a second strap upper portion and a second strap lower portion, wherein the first strap and second strap are attached to the rear portion of the body, further wherein the first strap and second strap comprise elastic material; and a first strap line extending from the left shoulder region to the right leg on the rear portion of the body and a second strap line extending from the right shoulder region to the left leg on the rear portion of the body, wherein the first strap line and second strap line intersect at an intersection; wherein the first strap upper portion is positioned along the first strap line above the intersection, and the second strap upper portion is positioned along the second strap line above the intersection, and further wherein the first strap lower portion is positioned along one of the first strap line or the second strap line below the intersection, and the second strap lower portion is positioned along the other of the first strap line or the second strap line below the intersection.

In one or more embodiments of the protective garments described herein, the body comprises waist region located below the left and right sleeve openings and above the crotch axis, and wherein the intersection of the first strap line and the second strap line is located within the waist region. In one or more embodiments, the first strap and second strap cross in the waist region.

In one or more embodiments of the protective garments described herein, the first strap lower portion extends from the intersection of the first strap line and the second strap line to at least the crotch axis.

In one or more embodiments of the protective garments described herein, the second strap lower portion extends from the intersection of the first strap line and the second strap line to at least the crotch axis.

In one or more embodiments of the protective garments described herein, the first strap lower portion extends from the intersection of the first strap line and the second strap line to below the crotch axis, and the second strap lower portion extends from the intersection of the first strap line and the second strap line to below the crotch axis. In one or more embodiments, a portion of the first strap lower portion extends onto the right leg, and a portion of the second strap lower portion extends onto the left leg. In one or more embodiments, a portion of the first strap lower portion extends onto the left leg, and a portion of the second strap lower portion extends onto the right leg.

In one or more embodiments of the protective garments described herein, the first strap comprises a first strap upper end in the left shoulder region and a first strap lower end, wherein the first strap is continuous between the first strap upper end and the first strap lower end, and wherein the second strap comprises a second strap upper end in the right shoulder region and a second strap lower end, wherein the second strap is continuous between the first strap upper end and the first strap lower end.

In one or more embodiments of the protective garments described herein, the first strap and second strap are adhesively attached to the body.

In one or more embodiments of the protective garments described herein, the rear portion body comprises a rear seam joining a first seam edge of a first rear panel to a second seam edge of a second rear panel between the neck opening and the crotch point, wherein the first seam edge comprise a first curve opening in one direction from the seam edge and a second curve opening in an opposing direction from the first curve. In one or more embodiments, the first curve comprises a radius of curvature that is greater than a radius of curvature of the second curve. In one or more embodiments, the first curve is located in an upper portion of the seam edge that extends from an end of the seam edge located proximate the neck opening of the garment towards the crotch point of the garment. In one or more embodiments, the second curve is located in a lower portion of the seam edge that extends from an end of the seam edge located proximate the crotch point of the garment towards the neck opening of the garment. In one or more embodiments, the first curve comprises a radius of curvature of 2 meters or more. In one or more embodiments, the second curve comprises a radius of curvature of 0.25 meters or more.

In another aspect, one or more embodiments of methods of manufacturing a protective garment are described herein, where the protective garment includes a body comprising a front portion, a rear portion and a neck opening, a left sleeve attached to the body at a left sleeve opening and a right sleeve attached to the body at a right sleeve opening, a left leg and a right leg extending from the body, a left shoulder region located between the left sleeve opening and the neck opening, a right shoulder region located between the right sleeve opening and the neck opening, a crotch region comprising a crotch point where the left and right legs meet the body, wherein a crotch axis extends horizontally through the crotch point when the garment is worn by a person standing upright. The one or more embodiments of the methods may include: attaching a first strap comprising a first strap upper portion and a first strap lower portion to a rear portion of the body and attaching a second strap comprising a second strap upper portion and a second strap lower portion to the rear portion of the body, wherein the first strap and second strap comprise elastic material, and wherein the first strap and the second strap are elongated before attaching them to the rear portion of the body; wherein a first strap line extends from the left shoulder region to the right leg on the rear portion of the body and a second strap line extends from the right shoulder region to the left leg on the rear portion of the body, and wherein the first strap line and second strap line intersect at an intersection; wherein attaching the first strap upper portion comprises attaching the first strap upper portion along the first strap line above the intersection and attaching the second strap upper portion comprises attaching the second strap upper portion along the second strap line above the intersection; and wherein attaching the first strap lower portion comprises attaching the first strap lower portion along one of the first strap line or the second strap line below the intersection and attaching the second strap lower portion comprises attaching the second strap lower portion along the other of the first strap line or the second strap line below the intersection.

In one or more embodiments of the methods of manufacturing a protective garment as described herein, the body comprises waist region located below the left and right sleeve openings and above the crotch axis, and wherein the first strap and second strap cross in the waist region.

In one or more embodiments of the methods of manufacturing a protective garment as described herein, the first strap lower portion extends from the intersection of the first strap line and the second strap line to at least the crotch axis, and the second strap lower portion extends from the intersection of the first strap line and the second strap line to at least the crotch axis.

In one or more embodiments of the methods of manufacturing a protective garment as described herein, the first strap lower portion extends from the intersection of the first strap line and the second strap line to below the crotch axis, and the second strap lower portion extends from the intersection of the first strap line and the second strap line to below the crotch axis.

As used herein and in the appended claims, the singular forms "a," "an," and "the" include plural referents unless the context clearly dictates otherwise. Thus, for example, reference to "a" or "the" component may include one or more of the components and equivalents thereof known to those skilled in the art. Further, the term "and/or" means one or all of the listed elements or a combination of any two or more of the listed elements.

It is noted that the term "comprises" and variations thereof do not have a limiting meaning where these turns appear in the accompanying description. Moreover, "a," "an," "the," "at least one," and "one or more" are used interchangeably herein.

The above summary is not intended to describe each embodiment or every implementation of the garment and methods of making described herein. Rather, a more complete understanding of the invention will become apparent and appreciated by reference to the following Description of Illustrative Embodiments and claims in view of the accompanying figures of the drawing.

DESCRIPTION OF ILLUSTRATIVE EMBODIMENTS

Figure 1:
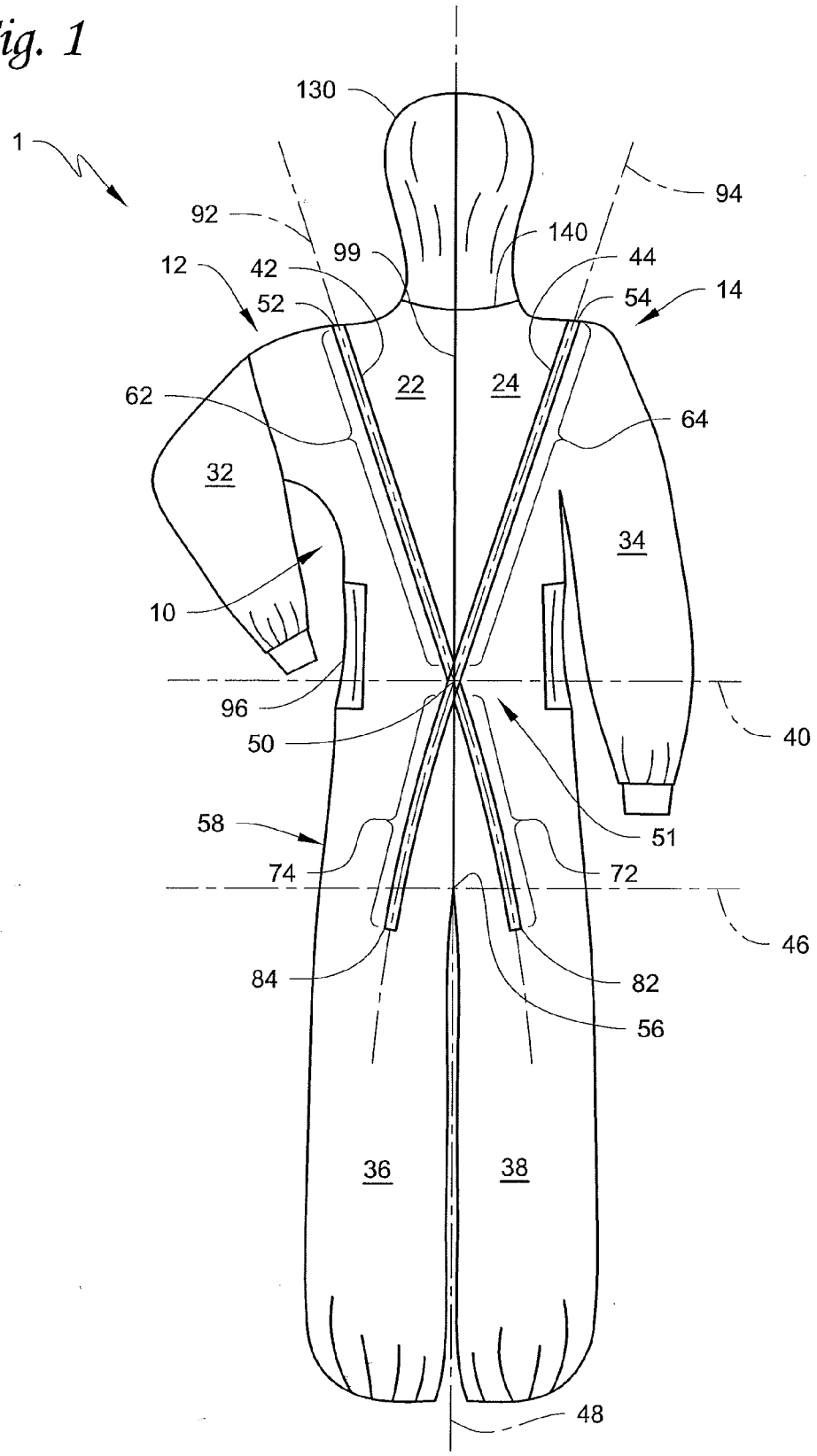
FIG. 1 is a rear view of one illustrative embodiment of a garment as described herein.

In the following description of illustrative embodiments, reference is made to the accompanying figures of the drawing which form a part hereof, and in which are shown, by way of illustration, specific embodiments. It is to be understood that other embodiments may be utilized and structural changes may be made without departing from the scope of the present invention.

Figure 2:
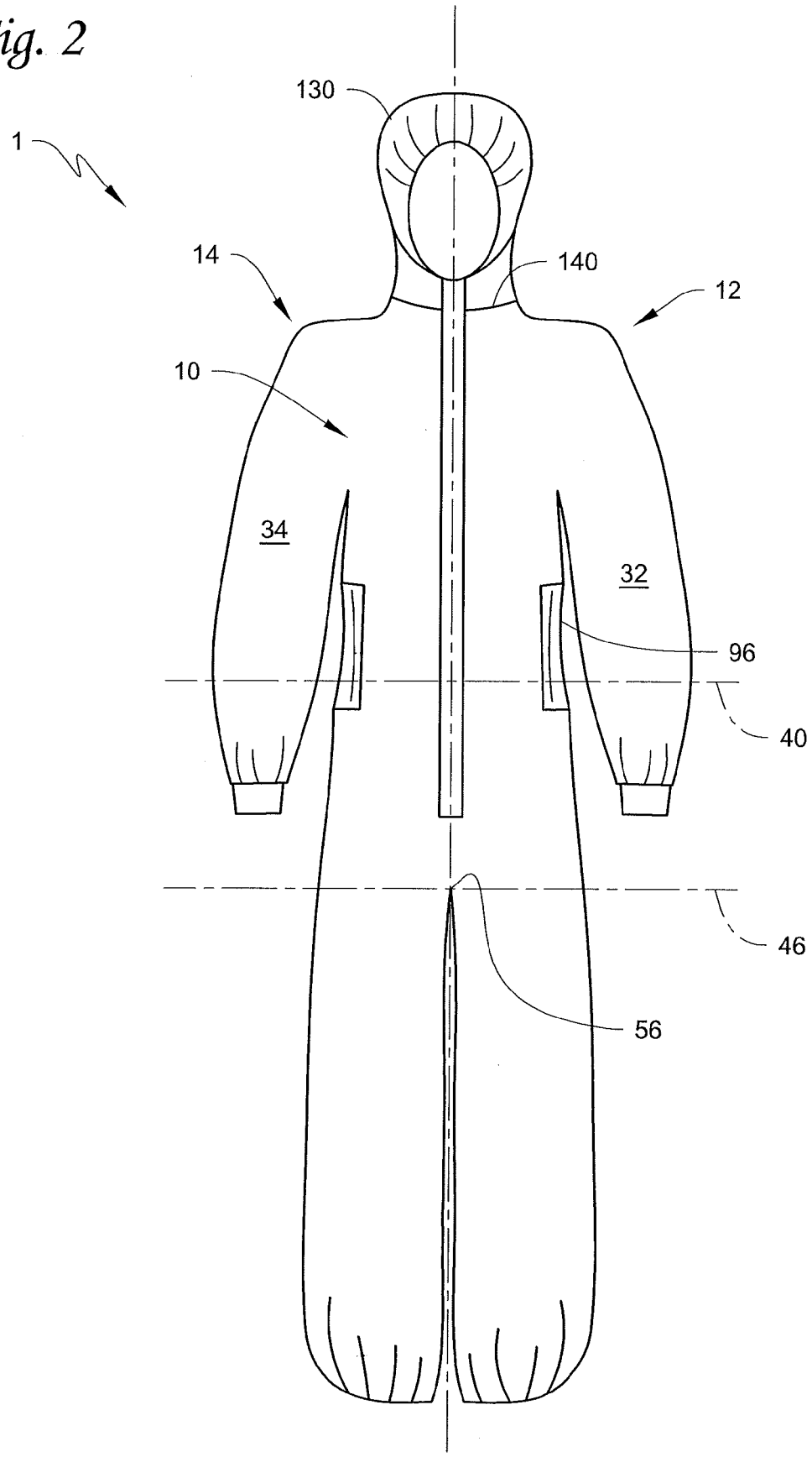
FIG. 2 is a front view of the garment of FIG. 1.

Referring to FIGS. 1 and 2, one illustrative embodiment of a protective garment is depicted. The garment 1 includes a body 10 having a rear portion as seen in FIG. 1 and front portion as seen in FIG. 2. Garment 1 further includes a left sleeve 32 extending from a left sleeve opening in the body 10 and a right sleeve 34 extending from a right sleeve opening in the body 10 in an upper region of the body 10 (e.g., region of the body between the right sleeve opening and the left sleeve opening). A left leg 36 and a right leg 38 extend from a lower region of the body 10 (e.g., region of the body 10 below the sleeves). Body 10 includes a left shoulder region 12 located between neck opening 140 and the left sleeve opening from which the left sleeve 32 extends, and a right shoulder region 14 located between neck opening 140 and the right sleeve opening from which the right sleeve 34 extends. The garment 1 includes a neck opening 140, and may, in one or more embodiments, include a hood 130 extending from the neck opening 140.

A crotch region 58 of the body 10 is located below a waist region 51 and includes a crotch point 56 located where the left and right leg portions 36, 38 meet the body 10. The crotch region 58 further includes a crotch axis 46 (which may also be viewed as a crotch plane extending into/out of the paper) defined by a horizontal axis that intersects the crotch point 56. The crotch axis 46 intersects a longitudinal axis 48 (which may be viewed as a longitudinal plane extending into/out of the paper) of garment 1 in a generally, or substantially perpendicular manner when the garment is worn by a person standing upright such that the crotch axis 46 extends horizontally.

The waist region 51 occupies an area of the body 10 above the crotch region 28 and below the sleeve openings from which the left and right sleeves 32, 34 extend. The waist region 51 further includes a waist axis 40 (which may also be viewed as a waist plane extending into/out of the paper) that intersects the longitudinal axis 48 (or plane) of garment 1. In one or more embodiments, the waist axis (or plane) 40 and longitudinal axis (or plane) 48 may intersect in a generally, or substantially perpendicular manner when the garment is in an unfolded configuration when the garment is worn by a person standing upright.

The rear of the garment 1 includes a left rear portion 22 and a right rear portion 24, which are joined together at a rear seam 99 as depicted in FIG. 1. Although the left rear portion 22 and the right rear portion 24 are depicted as being constructed of a single piece of material joint along rear seam 99, in alternative embodiments, the various portions may be constructed of two or more pieces of material joint along any number of seams as needed. In fact, the garment 1 as depicted in FIGS. 1 and 2 includes exemplary panels connected along exemplary seam lines, the various parts of garments as described herein may be foamed from any number of pieces and/or seams.

In one or more embodiments, garment 1 includes a first strap 42 and a second strap 44, both including elastic material and being joined to the rear of the body 10 along first and second strap lines 92, 94. The straps 42, 44 may be attached to the exterior or interior surface of the rear of the body 10. In the view seen in FIG. 1, the body 10 is depicted as transparent to allow visualization of the straps through the material used to form the body 10, with the understanding that the straps are actually attached to the interior surface of the rear of the body 10.

First strap 42 includes a first strap upper end 52, and a first strap lower end 82. First strap 42 further includes a first strap upper portion 62 and a first strap lower portion 72. Second strap 44 includes a second strap upper end 54 and a second strap lower end 84. Second strap 44 further includes a second strap upper portion 64, a second strap lower portion 74.

First strap 42 and second strap 44 may be attached to the body 10 of garment 1 by any suitable technique or combination of techniques, e.g., adhered, sewn, welded, etc. In one or more embodiments, the first and second straps 42, 44 may be placed along first and second strap lines 92, 94 including a first strap line 92 extending from the left shoulder region 12 to the right leg 38, and a second strap line 94 extending from the right shoulder region 14 to the left leg 36. The first and second strap lines 92, 94 may be straight and/or curved, i.e., the entire line may be straight, the entire line may be curved, portions of the line may be straight or one or more portions of the line may be curved, etc.

The first strap line 92 and second strap line 94 intersect at intersection 50. In one or more embodiments, intersection 50 may be in the waist region 51. The intersection 50 may, in one or more embodiments, be located at the intersection of the longitudinal axis 48 and the waist axis 40. In one or more alternative embodiments, the intersection 50 may be located above or below the intersection of the longitudinal axis 48 and the waist axis 40.

The first and second straps 42, 44 may be placed along first and second strap lines 92, 94 in a variety of configurations. For example, in one embodiment as shown in FIG. 1, a first strap 42 (including both a first strap upper portion 62 and a first strap lower portion 72) may be located entirely along first strap line 92. Similarly, a second strap 44 (including a second strap upper portion 64 and a second strap lower portion 74) may be located entirely along second strap line 94. In this configuration, the first and second straps 42, 44 may cross at intersection 50 although some alternative variations in the configuration of the straps 42, 44 at or near the intersection 50 are described herein.

With further reference to the embodiment of FIG. 1, the first strap 42 extends along strap line 92 from a first strap upper end 52 (located in the left shoulder region 12) to the first strap lower end 82 located below crotch axis 46 (e.g., the first strap 42 may extend below the crotch point 56 or the crotch axis 46 and onto right leg 38). Also with regard to the embodiment of FIG. 1, the second strap 44 extends along strap line 94 from a second strap upper end 54 (located in the right shoulder region 14) to the second strap lower end 84 located below crotch axis 46 (e.g., the second strap 44 may extend below the crotch point 56 or the crotch axis 46 and onto left leg 36).

As described herein, the first strap 42 as depicted in FIG. 1 includes a first strap upper portion 62 located above intersection 50 and a first strap lower portion 72 located below intersection 50. Similarly, the second strap 44 includes a second strap upper portion 64 located above intersection 50 and a second strap lower portion 74 located below intersection 50. The first strap lower portion 72 may, in one or more embodiments, extend from intersection 50 towards the crotch region 58 along first strap line 92 and terminate at the first strap lower end 82 which, in the depicted embodiment, is located below crotch point 56 or crotch axis 46. The second strap lower portion 74 may, in one or more embodiments, extend from intersection 50 towards the crotch region 58 along second strap line 94 and terminate at the second strap lower end 84 which, in the depicted embodiment, is located below crotch point 56 or crotch axis 46.

In addition to the illustrative embodiment depicted in FIG. 1, a variety of other first and second strap 42, 44 configurations are possible, particularly in regard to the positioning of the first strap lower portion 72 and second strap lower portion 74, and the locations of the first strap lower end 82 and second strap lower end 84.

In one or more embodiments, the upper portions 62, 72 of the first strap 42 and the second strap 44 may extend from the left and right shoulder regions 12, 14, respectively, as in the previous embodiment. However, alternate configurations of the first strap lower portion 72 and second strap lower portion 74 are possible. For example, the first strap lower portion 72 and the second strap lower portion 74 of the first and second straps 42, 44 may, in one or more embodiments, not extend past the crotch axis 46 (as is depicted in FIG. 1). In such embodiments, the first strap lower portion 72 may extend from intersection 50 (as in the previous embodiment), but may terminate at a first strap lower end 82 that is, e.g., above or in line with the crotch axis 46 (as opposed to extending below the crotch axis 46 as depicted in FIG. 1). Similarly, the second strap lower portion 74 may also extend from intersection 50 (as in the previous embodiment), but may also terminate at a second strap lower end 84 that is, e.g., located above or in line with the crotch axis 46 (as opposed to extending below the crotch point 56 or crotch axis 46 as depicted in FIG. 1).

In addition to variations in the location of the first and second strap ends 82, 84, in one or more embodiments, variations of the placement of the first strap 42 and the second strap 44 with respect to the first strap line 92 and the second strap line 94 are also possible.

Figure 3:
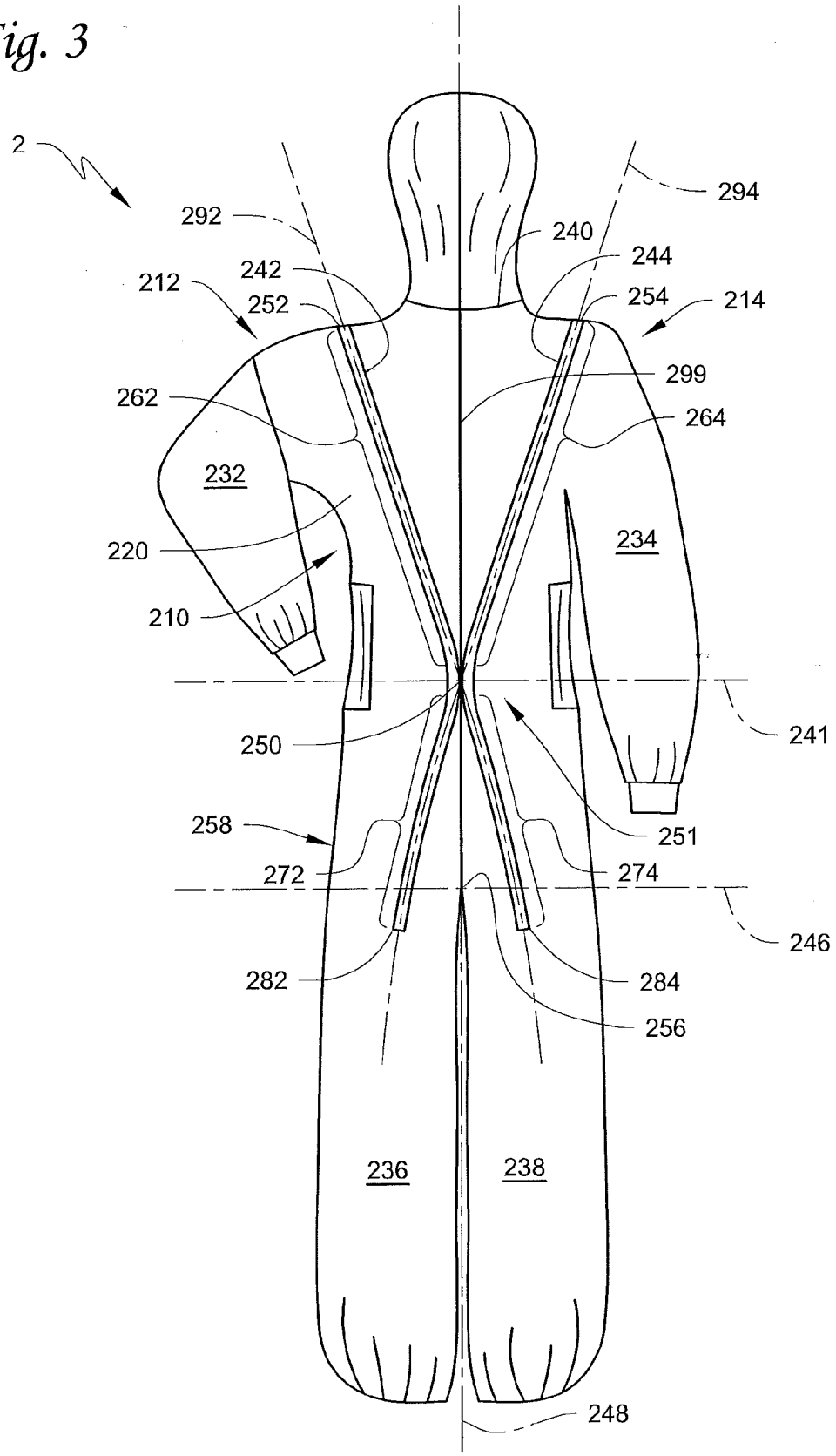
FIG. 3 is a rear view of one alternative illustrative embodiment of a garment as described herein.

An alternative illustrative embodiment of a garment as described herein is depicted in FIG. 3. In one or more embodiments, a garment 2 includes a body 210 having a rear portion as seen in FIG. 3. Garment 2 further includes a left sleeve 232 and a right sleeve 234 extending from left and right sleeve openings in an upper region of the body 210, and further includes a left leg 236 and a right leg 238 extending from a lower region of the body 210. Body 210 includes a left shoulder region 212 located between a neck opening 240 and the left sleeve opening from which the left sleeve 232 extends, and a right shoulder region 214 located between neck opening 240 and right sleeve opening from which the right sleeve 234 extends.

A crotch region 258 is located below a waist region 251 and includes a crotch point 256 located where the first and second legs 236, 238 meet the body 10. The crotch region 258 further includes a crotch axis 246 (which may also be viewed as a crotch plane extending into/out of the paper) defined by a horizontal axis that intersects the crotch point 256. In one or more embodiments, the crotch axis 246 intersects a longitudinal axis 248 (which may be viewed as a longitudinal plane extending into/out of the paper) of garment 2 in a generally, or substantially perpendicular manner when the garment is worn by a person standing upright such that the crotch axis 246 extends horizontally.

The waist region 251 includes an area of the body 210 above the crotch region 258 and below the sleeve openings from which the left and right sleeves 232, 234 extend. The waist region 251 further includes a waist axis 241 (which may also be viewed as a waist plane extending into/out of the paper) that intersects the longitudinal axis (or plane) 248 of garment 2. In one or more embodiments, the waist axis (or plane) 241 and longitudinal axis (or plane) 248 may intersect in a generally, or substantially perpendicular manner when the garment is worn by a person standing upright.

In one or more embodiments, garment 2 includes a first strap 242 and a second strap 244, both including elastic material and being joined to the rear portion 220 of the body 210 along first and second strap lines 242, 244. First strap 242 and second strap 244 may be attached to the garment 2 by any suitable technique or combination of techniques, e.g., adhered, sewn, welded, etc. First strap 242 includes a first strap upper end 252 and a first strap lower end 282. First strap 242 further includes a first strap upper portion 262 and a first strap lower portion 272. Second strap 244 includes a second strap upper end 254 and a second strap lower end 284. Second strap 244 further includes a second strap upper portion 264 and a second strap lower portion 274.

In most respects the construction of garment 2 is similar to the construction of garment 1, but differs from the embodiment of FIG. 1 at least with regard to the placement of the first strap 242 and the second strap 244.

In one or more embodiments, the first and second straps 242, 244 may be placed along first and second strap lines 292, 294, including a first strap line 292 extending from the left shoulder region 212 to the right leg 238, and a second strap line 294 extending from the right shoulder region 214 to the left leg portion 236. The first and second strap lines 292, 294 may be straight and/or curved, i.e., the entire line may be straight, the entire line may be curved, portions of the line may be straight or one or more portions of the line may be curved, etc.

The first strap line 292 and the second strap line 294 intersect at an intersection 250. In one or more embodiments, intersection 250 may be in the waist region 251. The intersection 250 may, in one or more embodiments, be located at the intersection of the longitudinal axis 248 and the waist axis 240. In one or more alternative embodiments, the intersection 250 may be located above or below the intersection of the longitudinal axis 248 and the waist axis 240.

In contrast to the first strap 42 and second strap 44 configuration of the embodiment of FIG. 1, the first strap 242 may not be positioned or located entirely along the first strap line 292 and the second strap 244 may not be positioned or located entirely along the second strap line 294 for the embodiment depicted in FIG. 3.

For example, in the embodiment shown in FIG. 3, the first strap upper portion 262 may be located along first strap line 292 (entirely or partially) while the first strap lower portion 272 may be located along second strap line 294 (entirely or partially). Similarly, the second strap upper portion 264 may be located along second strap line 294 (entirely or partially) while the second strap lower portion 274 may be located along first strap line 292 (entirely or partially). This differs from the configuration of the first and second straps 42, 44 of the embodiment depicted in FIG. 1 in which the first strap 42 is located entirely along a first strap line 92 while the second strap before it is located entirely along the second strap line 94.

In other words, the first strap 242 as depicted in FIG. 3 includes a first strap upper portion 262 located above intersection 250 and a first strap lower portion 272 located below intersection 250. The first strap lower portion 272 may, in one or more embodiments, extend from intersection 250 towards the crotch region 258 along first second strap line 294, and terminate at the first strap lower end 282 which, in the depicted embodiment, is located below crotch axis 246.

Similarly, the second strap 244 includes a second strap upper portion 264 located above intersection 250 and a second strap lower portion 273 located below intersection 250. The second strap lower portion 274 may, in one or more embodiments, extend from intersection 250 towards the crotch region 258 along first strap line 292 and terminate at the second strap lower end 284 which, in the depicted embodiment, is located below crotch axis 246.

In such a configuration the first strap 242 and second strap 244 do not cross each other at intersection 250. In one or more embodiments, the first strap 242 and the second strap 244 may approach each other at or near the intersection 250 but not actually touch each other. In one or more alternative embodiments, one of the first strap 242 and second strap 244 may be located on top of the other strap, although such an arrangement is not required.

In addition to the illustrative embodiment depicted in FIG. 3, other first and second strap 242, 244 configurations are possible, particularly in regard to the positioning or location of the first strap lower end 282 and second strap lower end 284 (e.g., locations at which the first strap lower end 282 and second strap lower end 284 terminate).

Alternate configurations of the first strap lower portion 272 and second strap lower portion 274 are possible. For example, the first strap lower portion 272 and the second strap lower portion 274 of the first and second straps 242, 244 may, in one or more embodiments, not extend past the crotch axis 246. In such embodiments, the first strap lower portion 272 may extend from intersection 250, but may terminate at a first strap lower end 282 that is, e.g., above or in line with the crotch axis 246 (as opposed to extending below the crotch axis 246 as depicted in FIG. 3). Similarly, the second strap lower portion 274 may extend from intersection 250, but may terminate at a second strap lower end 284 that is, e.g., above or in line with the crotch axis 246 (as opposed to extending below the crotch axis 246 as depicted in FIG. 3).

The elastic straps used in the garments described herein may be formed of any suitable construction that provides elasticity in a strap like form. Some potentially suitable constructions of elastic straps used in the garments described herein may include, but are not limited to: an elastic article attached to garments using a double-sided adhesive tape (where the double-sided adhesive may, itself, be elastic or inelastic). One example of a potentially suitable elastic article that may be used in one or more embodiments may be, e.g., an article marketed by 3M Company as "3M™ Fluted Elastic" which may be paired with a double-sided adhesive tape (or may, in one or more alternative embodiments, be provided with adhesive coated on one side so that it can be attached directly to a garment without requiring the double-sided adhesive tape).

The elastic straps used in the garments described herein may, in one or more embodiments, be capable of elastic elongation in the range of about 10% or more (i.e., elastic elongation of at least about 1.1 times an original length such that, for example, an elastic strap having an original length of 1 meter may be elongated to a length of about 1.1 meters or more). At an upper end, elastic straps used in the garments described herein may, in one or more embodiments, be capable of elastic elongation in the range of about 400% or less (i.e., elastic elongation of up to about 4 times an original length such that, for example, an elastic strap having an original length of 1 meter may be elongated up to a length of about 4 meters or less). As used herein, "elastic elongation" (and variations thereof) describe elastic articles, straps, etc. that returning to at or near their original length when the elongation force is removed. Depending on the elastic material selected, including the orientation and direction of stretch of the elastic strap, strength and durability, etc., a greater or lower level of elongation may be required.

The elastic straps as described herein may be attached to the garments as described herein in any manner that allows the elastic straps to extend/length in the presence of an elongation force and retract/shorten when the elongation force is removed. As described herein, the elongation forces may be applied as a user who is wearing the garment moves. Because the elastic straps are attached to the garments while elongated, removal of the elongation force after attachment will typically cause the material of the garment to be shirred along the length of the elastic straps.

The degree of stretching or elongation of the elastic material during construction of the garments as described herein may vary depending on the elongation, retraction and adhesive strength properties (as applicable) of the particular elastic material used in the elastic straps. Further, the elastic straps may be attached to the garments such that they are always in a state of tension in the absence of an external elongation force due to the resistance to retraction of the elastic straps provided by the material of the garments to which the straps are attached.

In one example, the elastic straps used in a garment as described herein may be elongated or stretched 33% before or as it is attached to the material of the garment. For example, a 33 inch (approx. 0.8 m) long strap would be stretched to 44 inches (approx. 1.1 m) before or as it is attached to a garment as described herein. The elastic straps used in garments as described herein may, of course, be provided in a range of lengths to accommodate garments of different sizes in order to accommodate individuals of different sizes. Other factors considered in selecting the elastic straps and the amount of elongation that is applied to the straps before attaching them to garments as described herein may include, e.g., properties of the elastic material in the elastic straps, properties of material used to construct the garments, manufacturing capabilities, environmental factors (e.g., temperature, humidity, etc.), the desired design characteristics, etc.

Although the elastic straps used in the garments as described herein may exhibit elasticity that is continuous along the entire length of the elastic strap, elastic straps used in other embodiments of garments as described herein may contain portions that exhibit elasticity and other portions that do not exhibit elasticity (e.g., for example, alternating sections of elastic and inelastic material, or regions of varying degrees of elasticity). In still other variations, the elastic straps used in garments as described herein may be continuous along their length or they may be formed of two or more pieces that are overlapped or joined together or placed adjacent to one another to form an elastic strap located along a strap line as described herein. In one or more embodiments, the elastic straps described herein may include specific sections of increased resistance to elongation for improved fit or reinforcement of particular sections of the garments as described herein.

Referring to FIGS. 1 & 3, in one or more embodiments of garments as described herein one or more elastic panels 96 may be provided in waist region 51. The elastic panels 96 may be proximate to or within the waist region 51 and may be of any shape or material suitable to provide the user good fit, form and function. Any number of elastic panels 96 occupying up to 100% of the waist region may be provided, the elastic panels may be provided in any suitable location, including the right and left sides of waist region 51. In other embodiments, the elastic panels 96 may be placed in another area of the waist region 51, or may be a single panel occupying a circumferential ring of the waist region 51.

Figure 4:
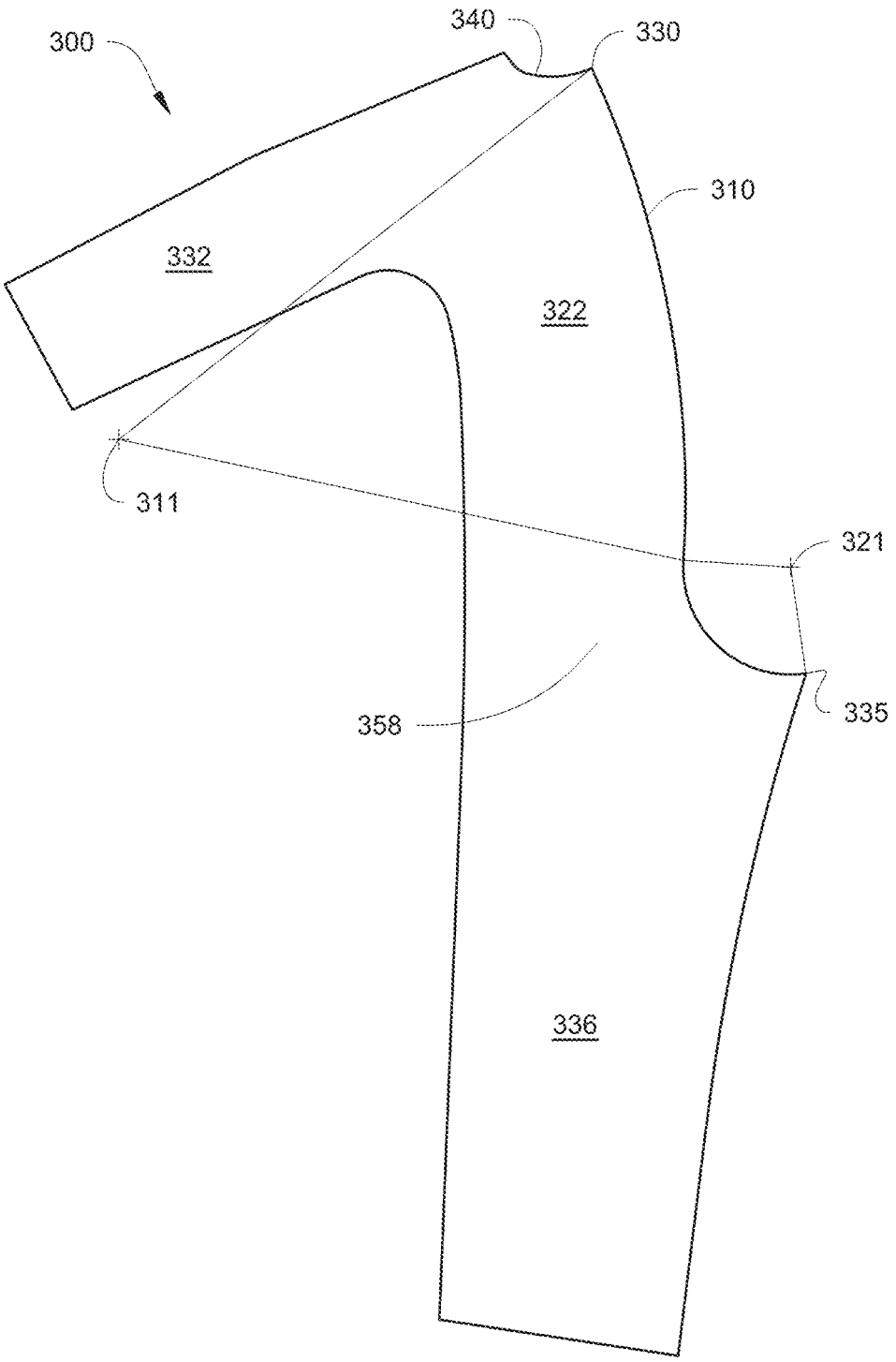
FIG. 4 depicts one illustrative embodiment of a rear panel that could be used to construct a garment as described herein.

Referring to FIG. 4, the garments as described herein may be formed in a pattern that includes panels joined together. In particular, the rear portion of the garment may include a vertical seam line that extends along the rear of the body of the garment from, e.g., the neck opening to the crotch point. For example, reference is made to the seam 99 as depicted in FIG. 1 in connection with the garment 1, in which the seam 99 extends from the neck opening 140 to the crotch point 56.

One illustrative embodiment of a rear panel 300 that may be used in construction of a garment as described herein is depicted in FIG. 4. The rear panel 300 includes a body portion 322, a sleeve 332 extending from the upper region of the body portion 322, and a leg 36 extending from the lower end of the body portion 322.

The first rear panel 300 may further include a seam edge 310 including an upper endpoint 330 proximate the neck region 340, and a lower endpoint 335 located in the crotch region 358. Rear panel 300 may be joined to a second rear panel (where the second rear panel is a mirror image of first rear panel 300 shown in FIG. 4) to form the rear of a garment as described herein. When joined together, the seam edges 310 of the pair of panels would form a rear seam such as, e.g., rear seam 99 or rear seam 299 as seen in (FIGS. 1 and 3, respectively).

The edges 310 of the rear panels 300 may, in one or more embodiments, be curved along their length between upper endpoint 330 and lower endpoint 335 (when the rear panel 300 is laying on a flat surface). In the depicted embodiment, the seam edge 310 includes at least two curves, with a first curve located in an upper portion of the seam edge 310 and a second curve located in a lower portion of the seam edge 310. The upper portions containing the first curves may extend from the ends of the seam edges 310 located proximate the neck openings of the garments as described herein and extending towards the ends of the seam edges 310 located proximate the crotch points of the garments described herein. The lower portions containing the second curves may extend from the ends of the seam edges 310 located proximate the crotch points of the garments as described herein and extending towards the ends of the seam edges 310 located proximate the neck openings of the garments described herein.

The first and second curves of the seam edge 310 can be described as opening in opposite directions such that, e.g., the seam edge 310 could be described as having a generally S-shaped curvature made of two different curves opening in opposite directions from the seam edge 310. For example, the first curve in the upper portion of the seam edge 310 is curved about a point 311 located on one side of seam edge 310, while the second curve in the lower portion of the seam edge 310 is curved about a point 321 located on the opposite side of the seam edge 310. The first curve located in the upper portion of each seam edge 310 may, in one or more embodiments, have a radius of curvature greater than a radius of curvature of the second curve located in the lower portion of the seam edge 310. For example, the first curve in the upper portion of each seam edge 310 may, in one or more embodiments, have a radius of curvature of, e.g., 2 meters or more while the second curve in the lower portion of the seam edge 310 may have a radius of curvature of, e.g., 0.25 meters or more. In both cases, the curves may, in one or more embodiments, have a radius of curvature of 20 meters or less. Because the seam edges 310 are curved, the rear of the garments as described herein may also exhibit some curvature which may enhance the fit and comfort of the garments as described herein.

Illustrative embodiments of garments and methods of making the same are discussed herein and some possible variations have been described. These and other variations and modifications in the invention will be apparent to those skilled in the art without departing from the scope of the invention, and it should be understood that this invention is not limited to the illustrative embodiments set forth herein. Accordingly, the invention is to be limited only by the claims provided below and equivalents thereof.

What is claimed is:

1. A protective garment comprising:

a body comprising a front portion, a rear portion and a neck opening;

a left sleeve attached to the body at a left sleeve opening and a right sleeve attached to the body at a right sleeve opening;

a left leg and a right leg each extending from the body;

a left shoulder region located between the left sleeve opening and the neck opening;

a right shoulder region located between the right sleeve opening and the neck opening;

a crotch region comprising a crotch point where the left and right legs meet the body, wherein a crotch axis extends horizontally through the crotch point when the garment is worn by a person standing upright;

a first strap comprising a first strap upper portion and a first strap lower portion, and a second strap comprising a second strap upper portion and a second strap lower portion, wherein the first strap and the second strap are each directly attached to a material forming the rear portion of the body wherein at least a portion of the first strap comprises an elastic strap that returns to at or near an original length after removal of an elongation force causing elastic elongation of the elastic strap of 10% or more, and wherein the first strap is directly attached to the material forming the rear portion of the body while the at least a portion of the first strap comprising the elastic strap is elastically elongated such that the material forming the rear portion is shirred where directly attached to the first strap when the first strap is in a relaxed configuration; and a first strap line extending from the left shoulder region to the right leg on the rear portion of the body and a second strap line extending from the right shoulder region to the left leg on the rear portion of the body, wherein the first strap line and second strap line intersect at an intersection;

wherein the first strap upper portion is positioned coincident with the first strap line above the intersection, and the second strap upper portion is positioned coincident with the second strap line above the intersection, and further wherein the first strap lower portion is positioned coincident with one of the first strap line or the second strap line below the intersection, and the second strap lower portion is positioned coincident with the other of the first strap line or the second strap line below the intersection wherein the body comprises a waist region located entirely below the left and right sleeve openings and entirely above the crotch point, and wherein the intersection of the first strap line and the second strap line is located within the waist region.

2. The protective garment of claim 1, wherein the first strap and second strap cross in the waist region.

3. The protective garment of claim 1, wherein the first strap lower portion extends from the intersection of the first strap line and the second strap line to at least the crotch axis.

4. The protective garment of claim 1, wherein the second strap lower portion extends from the intersection of the first strap line and the second strap line to at least the crotch axis.

5. The protective garment of claim 1, wherein the first strap lower portion extends from the intersection of the first strap line and the second strap line to below the crotch axis, and wherein the second strap lower portion extends from the intersection of the first strap line and the second strap line to below the crotch axis.

6. The protective garment of claim 5, wherein a portion of the first strap lower portion extends onto the right leg, and wherein a portion of the second strap lower portion extends onto the left leg.

7. The protective garment of claim 5, wherein a portion of the first strap lower portion extends onto the left leg, and wherein a portion of the second strap lower portion extends onto the right leg.

8. The protective garment of claim 1, wherein the first strap comprises a first strap upper end in the left shoulder region and a first strap lower end, wherein the first strap is continuous between the first strap upper end and the first strap lower end, and wherein the second strap comprises a second strap upper end in the right shoulder region and a second strap lower end, wherein the second strap is continuous between the first strap upper end and the first strap lower end.

9. The protective garment of claim 1, wherein the first strap and second strap are adhesively attached to the body.

10. The protective garment of claim 1, wherein the rear portion of the body comprises a rear seam joining a first seam edge of a first rear panel to a second seam edge of a second rear panel between the neck opening and the crotch point, further wherein the first seam edge comprises a first curve opening in one direction from the first seam edge and a second curve opening in an opposing direction from the first curve.

11. The protective garment of claim 10, wherein the first curve comprises a radius of curvature that is greater than a radius of curvature of the second curve.

12. The protective garment of claim 10, wherein the first curve is located in an upper portion of the first seam edge that extends from an end of the first seam edge located proximate the neck opening of the garment towards the crotch point of the garment.

13. The protective garment of claim 12, wherein the second curve is located in a lower portion of the first seam edge that extends from an end of the first seam edge located proximate the crotch point of the garment towards the neck opening of the garment.

14. The protective garment of claim 10, wherein the first curve comprises a radius of curvature of 2 meters or more.

15. The protective garment of claim 10, wherein the second curve comprises a radius of curvature of 0.25 meter or more.

16. A protective garment comprising:

a body comprising a front portion, a rear portion and a neck opening;

a left sleeve attached to the body at a left sleeve opening and a right sleeve attached to the body at a right sleeve opening;

a left leg and a right leg each extending from the body;

a left shoulder region located between the left sleeve opening and the neck opening;

a right shoulder region located between the right sleeve opening and the neck opening;

a crotch region comprising a crotch point where the left and right legs meet the body, wherein a crotch axis extends horizontally through the crotch point when the garment is worn by a person standing upright;

a first strap comprising a first strap upper portion and a first strap lower portion, and a second strap comprising a second strap upper portion and a second strap lower portion, wherein the first strap and the second strap comprise elastic material; and wherein the first strap and second strap are directly adhesively attached to a material forming the rear portion of the body, wherein at least a portion of the first strap comprises an elastic strap that returns to at or near an original length after removal of an elongation force causing elastic elongation of the elastic strap, and wherein the first strap is directly attached to the material forming the rear portion of the body while the at least a portion of the first strap comprising the elastic strap is elastically elongated such that the material forming the rear portion is shined where attached to the first strap when the first strap is in a relaxed configuration; and a first strap line extending from the left shoulder region to the right leg on the rear portion of the body and a second strap line extending from the right shoulder region to the left leg on the rear portion of the body, wherein the first strap line and second strap line intersect at an intersection;

wherein the first strap upper portion is positioned coincident with the first strap line above the intersection, and the second strap upper portion is positioned coincident with the second strap line above the intersection, and further wherein the first strap lower portion is positioned coincident with one of the first strap line or the second strap line below the intersection, and the second strap lower portion is positioned coincident with the other of the first strap line or the second strap line below the intersection;

and wherein the body comprises a waist region located entirely below the left and right sleeve openings and entirely above the crotch point, and wherein the intersection of the first strap line and the second strap line is located within the waist region.

17. The protective garment of claim 16, wherein the at least a portion of the first strap comprises an elastic strap that returns to at or near an original length after removal of an elongation force causing elastic elongation of the elastic strap of 10% or more.

18. The protective garment of claim 16, wherein the rear portion of the body comprises a rear seam joining a first seam edge of a first rear panel to a second seam edge of a second rear panel between the neck opening and the crotch point, further wherein the first seam edge comprises a first curve opening in one direction from the first seam edge and a second curve opening in an opposing direction from the first curve.

19. The protective garment of claim 18, wherein the first curve comprises a radius of curvature that is greater than a radius of curvature of the second curve.

* * * * *